US009151187B2

(12) United States Patent
Watanabe

(10) Patent No.: US 9,151,187 B2
(45) Date of Patent: Oct. 6, 2015

(54) VALVE TIMING CONTROL APPARATUS FOR INTERNAL COMBUSTION ENGINE

(71) Applicant: HITACHI AUTOMOTIVE SYSTEMS, LTD., Hitachinaka-shi, Ibaraki (JP)

(72) Inventor: Atsushi Watanabe, Kanagawa (JP)

(73) Assignee: HITACHI AUTOMOTIVE SYSTEMS, LTD., Hitachinaka-Shi, Ibaraki (JP)

( * ) Notice: Subject to any disclaimer, the term of this patent is extended or adjusted under 35 U.S.C. 154(b) by 0 days.

(21) Appl. No.: 14/017,745

(22) Filed: Sep. 4, 2013

(65) Prior Publication Data

US 2014/0069361 A1 Mar. 13, 2014

(30) Foreign Application Priority Data

Sep. 7, 2012 (JP) ..... 2012-196715

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34483* (2013.01)

(58) Field of Classification Search
CPC ..... F01L 2001/34483
USPC ..... 123/90.15, 90.17
See application file for complete search history.

(56) References Cited

U.S. PATENT DOCUMENTS

| | | | | |
|---|---|---|---|---|
| 7,987,829 | B2 * | 8/2011 | Dupuis et al. | 123/90.17 |
| 8,662,039 | B2 * | 3/2014 | Fischer et al. | 123/90.17 |
| 2001/0039932 | A1 * | 11/2001 | Sekiya et al. | 123/90.17 |
| 2002/0139330 | A1 * | 10/2002 | Takahashi et al. | 123/90.17 |
| 2005/0252468 | A1 * | 11/2005 | Tanaka et al. | 123/90.17 |
| 2005/0284432 | A1 * | 12/2005 | Tsukada | 123/90.17 |
| 2009/0020085 | A1 * | 1/2009 | Hattori | 123/90.17 |
| 2009/0069097 | A1 * | 3/2009 | Fischer | 464/1 |
| 2009/0126664 | A1 * | 5/2009 | Hayashi | 123/90.17 |
| 2011/0185994 | A1 * | 8/2011 | Hayashi | 123/90.17 |
| 2012/0160196 | A1 * | 6/2012 | Sakane | 123/90.15 |
| 2013/0233263 | A1 * | 9/2013 | Kinouchi | 123/90.17 |
| 2014/0090612 | A1 * | 4/2014 | Hayashi et al. | 123/90.15 |
| 2014/0202405 | A1 * | 7/2014 | Shinomiya | 123/90.15 |

FOREIGN PATENT DOCUMENTS

JP 2005-325749 A 11/2005

* cited by examiner

*Primary Examiner* — Thomas Denion
*Assistant Examiner* — Daniel Bernstein
(74) *Attorney, Agent, or Firm* — Foley & Lardner LLP

(57) ABSTRACT

A valve timing control apparatus including a vane rotor, a torsion spring having one end portion fixed to the vane rotor, and a front plate having a cylindrical sleeve portion and a cutout portion formed in the sleeve portion, the cutout portion having an end wall surface with which the other end portion of the torsion spring is engaged and a side wall surface opposed to the end wall surface, the cutout portion being formed such that a first straight line extending through the end wall surface toward a radial inside of the sleeve portion is located closer to a central axis of the sleeve portion than a second straight line extending through the side wall surface toward the radial inside of the sleeve portion.

18 Claims, 8 Drawing Sheets

VALVE TIMING CONTROL APPARATUS FOR INTERNAL COMBUSTION ENGINE

BACKGROUND OF THE INVENTION

The present invention relates to a valve timing control apparatus for an internal combustion engine which variably controls timings of opening and closing an engine valve (i.e., an intake valve and an exhaust valve) during an engine operation.

Japanese Patent Application Unexamined Publication No. 2005-325749 discloses a valve timing control apparatus that includes a housing constituted of a housing body and a front plate, a vane rotor and a torsion spring installed between the housing and the vane rotor. With the provision of the torsion spring, a biasing force of the torsion spring acts on the vane rotor to move against a reaction force of a valve spring (a force to retard a rotational phase of a camshaft) which is generated upon an opening operation and a closing operation of an engine valve. As a result, the valve timing control apparatus can be enhanced in operating performance and response performance.

SUMMARY OF THE INVENTION

However, in the valve timing control apparatus of the above conventional art, one end portion of the torsion spring is fixedly engaged in a through hole formed in a cylindrical sleeve portion projecting from the front plate. Due to the construction, the torsion spring must be mounted to the front plate in such a state that the biasing force of the torsion spring is exerted on the front plate, before assembling the front plate to the housing body. Thus, an operation of assembling the valve timing control apparatus is carried out with labor, and therefore, is made inconvenient.

It is an object of the present invention to solve the above-described technological problem in the conventional art and provide a valve timing control apparatus for an internal combustion engine which is capable of mounting a torsion spring to a front plate even after assembling the front plate to the housing body.

In one aspect of the present invention, there is provided a valve timing control apparatus for an internal combustion engine, including:

a generally cylindrical housing body rotatable by a rotational force that is transmitted from a crankshaft of the engine to the housing body, the housing body being opened to at least one axial end thereof, the housing body having a plurality of shoes projecting on an inner periphery thereof to define a plurality of hydraulic chambers;

a vane rotor including a rotor body fixed to a camshaft, and a plurality of vanes projecting on an outer periphery thereof to divide the plurality of hydraulic chambers into phase-advance hydraulic chambers and phase-retard hydraulic chambers, the vane rotor being rotatable relative to the housing body toward a phase-advance side by supplying hydraulic pressure to the phase-advance hydraulic chambers and discharging hydraulic pressure from the phase-retard hydraulic chambers, the vane rotor being rotatable relative to the drive rotation member toward a phase-retard side by supplying hydraulic pressure to the phase-retard hydraulic chambers and discharging hydraulic pressure from the phase-advance hydraulic chambers;

a front plate fixed to an axial end of the housing body, the front plate including a cylindrical sleeve portion that projects from a central portion of the front plate, and a cutout portion formed on a side of an axial end of the sleeve portion, the cutout portion extending through a circumferential wall of the sleeve portion in parallel to a radial direction of the sleeve portion over a predetermined angular range in a circumferential direction of the sleeve portion; and a torsion spring having one end portion fixed to the vane rotor and the other end portion bent in a radially outward direction of the torsion spring and fixedly engaged with the cutout portion, wherein the cutout portion comprises one side wall surface, the other side wall surface opposed to the one side wall surface in a substantially parallel relation thereto, and an end wall surface with which the other end portion of the torsion spring is engaged, the cutout portion being formed such that a first straight line extending through the end wall surface toward an inner peripheral side of the sleeve portion is located closer to a central axis of the sleeve portion than a second straight line extending through the other side wall surface toward the inner peripheral side of the sleeve portion.

In a further aspect of the present invention, there is provided a valve timing control apparatus for an internal combustion engine, including:

a generally cylindrical drive rotation member rotatable by a rotational force that is transmitted from a crankshaft of the engine to the drive rotation member, the drive rotation member being opened to at least one axial end thereof, the drive rotation member defining a plurality of hydraulic chambers on an inner peripheral side thereof;

a vane rotor fixed to a camshaft, the vane rotor dividing the plurality of hydraulic chambers into a phase-advance hydraulic chambers and phase-retard hydraulic chambers, the vane rotor being rotatable relative to the drive rotation member toward a phase-advance side by supplying hydraulic pressure to the phase-advance hydraulic chambers and discharging hydraulic pressure from the phase-retard hydraulic chambers, the vane rotor being rotatable relative to the drive rotation member toward a phase-retard side by supplying hydraulic pressure to the phase-retard hydraulic chambers and discharging hydraulic pressure from the phase-advance hydraulic chambers;

a front plate fixed to an axial end of the drive rotation member, the front plate including a cylindrical sleeve portion that projects from a central portion of the front plate, and a cutout portion formed on a side of an axial end of the sleeve portion, the cutout portion extending through a circumferential wall of the sleeve portion in parallel to a radial direction of the sleeve portion over a predetermined angular range in a circumferential direction of the sleeve portion; and a torsion spring having one end portion fixed to the vane rotor and the other end portion bent in a radially outward direction of the torsion spring and fixedly engaged with the cutout portion, wherein the cutout portion comprises one wall surface with which the other end portion of the torsion spring is engaged, and the other wall surface opposed to the one wall surface, the other wall surface making an obtuse angle relative to a tangent to an inner peripheral surface of sleeve portion.

In a still further aspect of the present invention, there is provided a valve timing control apparatus for an internal combustion engine, including:

a generally cylindrical drive rotation member rotatable by a rotational force that is transmitted from a crankshaft of the engine to the drive rotation member, the drive rotation member being opened to at least one axial end thereof, the drive rotation member defining a plurality of hydraulic chambers on an inner peripheral side thereof;

a vane rotor fixed to a camshaft, the vane rotor dividing the plurality of hydraulic chambers into a phase-advance hydraulic chambers and a phase-retard hydraulic chambers, the vane rotor being rotatable relative to the drive rotation member toward a phase-advance side by supplying hydraulic pressure to the phase-advance hydraulic chambers and discharging hydraulic pressure from the phase-retard hydraulic chambers, the vane rotor being rotatable relative to the housing body toward a phase-retard side by supplying hydraulic pressure to the phase-retard hydraulic chambers and discharging hydraulic pressure from the phase-advance hydraulic chambers;

a front plate fixed to an axial end of the drive rotation member, the front plate including a cylindrical sleeve portion that projects from a central portion of the front plate, and a cutout portion formed on a side of an axial end of the sleeve portion, the cutout portion extending through a circumferential wall of the sleeve portion in parallel to a radial direction of the sleeve portion over a predetermined angular range in a circumferential direction of the sleeve portion; and a torsion spring having one end portion fixed to the vane rotor and the other end portion bent in a radially outward direction of the torsion spring and fixedly engaged with the cutout portion, wherein the cutout portion comprises one wall surface with which the other end portion of the torsion spring is engaged, and the other wall surface opposed to the one wall surface, the cutout portion being formed in such a position that the one wall surface is located closer to a straight line extending across a central axis of the sleeve portion than the other wall surface, by cutting the circumferential wall of the sleeve portion along the radial direction of the sleeve portion by a punch having a predetermined width.

In the valve timing control apparatus for an internal combustion engine, according to the present invention, a torsion spring can be assembled to a front plate from an outside by engaging the other end of the torsion spring with the cutout portion of the sleeve portion. Therefore, the torsion spring can be assembled to the front plate after the front plate is assembled to the housing body. As a result, it is possible to facilitate an assembly work of the valve timing control apparatus without requiring labor in assembling parts such as the front plate to the housing body or the vane rotor against a biasing force of the torsion spring. Accordingly, the valve timing control apparatus according to the present invention can serve to enhance productivity and cost reduction thereof.

Further, with the above construction of the cutout portion, the cutout portion can be formed into an obtusely angled shape at an inner circumferential end thereof. Therefore, even in a case where a winding portion of the torsion spring is caused to be in an inclined state and press against an inner peripheral surface of the sleeve portion due to torque applied to the torsion spring, the torsion spring can be prevented from suffering from damage and local abrasion in the winding portion.

Other objects and features of this invention will become understood from the following description with reference to the accompanying drawings.

DETAILED DESCRIPTION OF THE INVENTION

In the following, a valve timing control apparatus for an internal combustion engine, according to an embodiment of the present invention is described with reference to the drawings.

Figure 1:
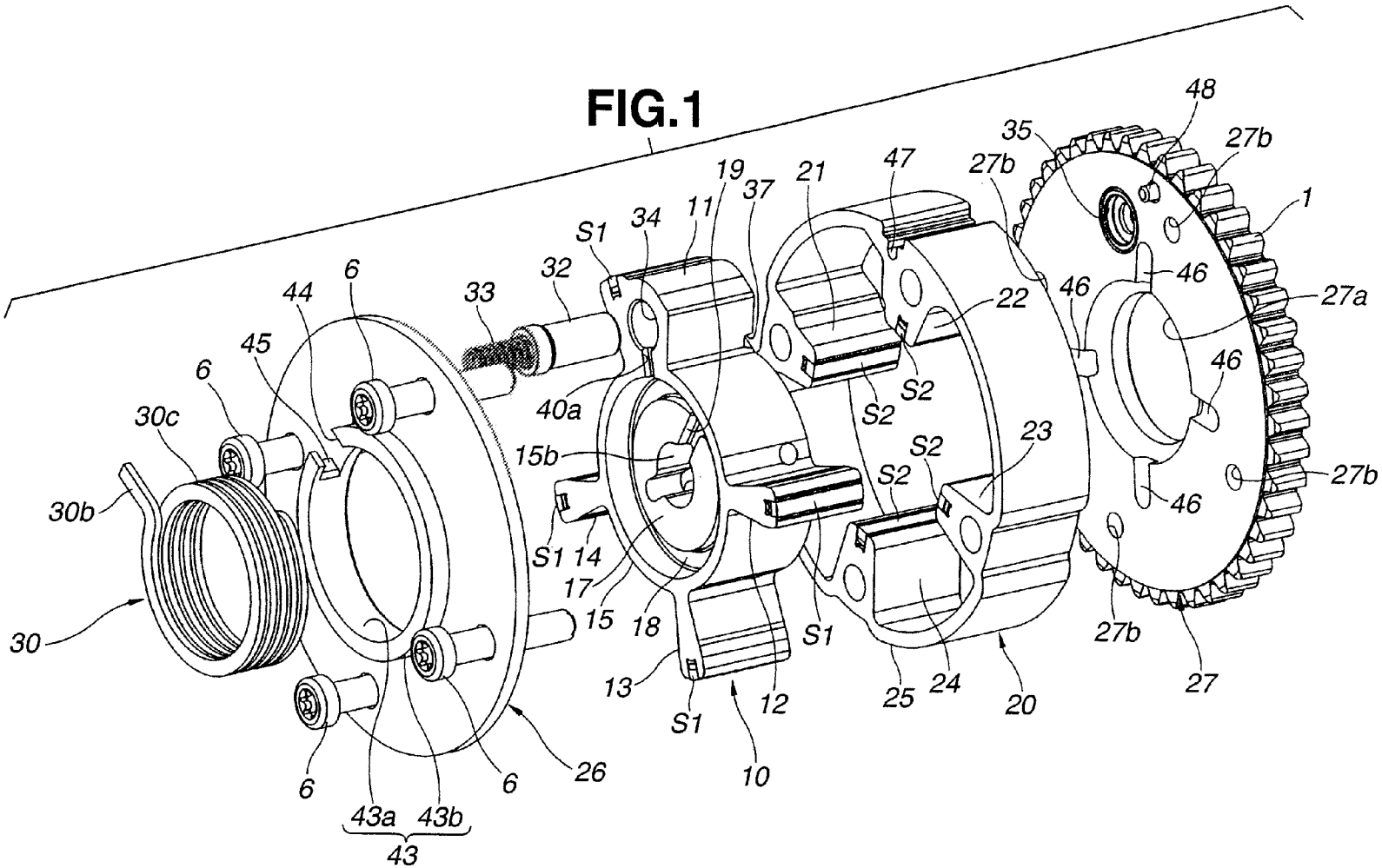
FIG. 1 is an exploded perspective view of a valve timing control apparatus according to an embodiment of the present invention.
Figure 2:
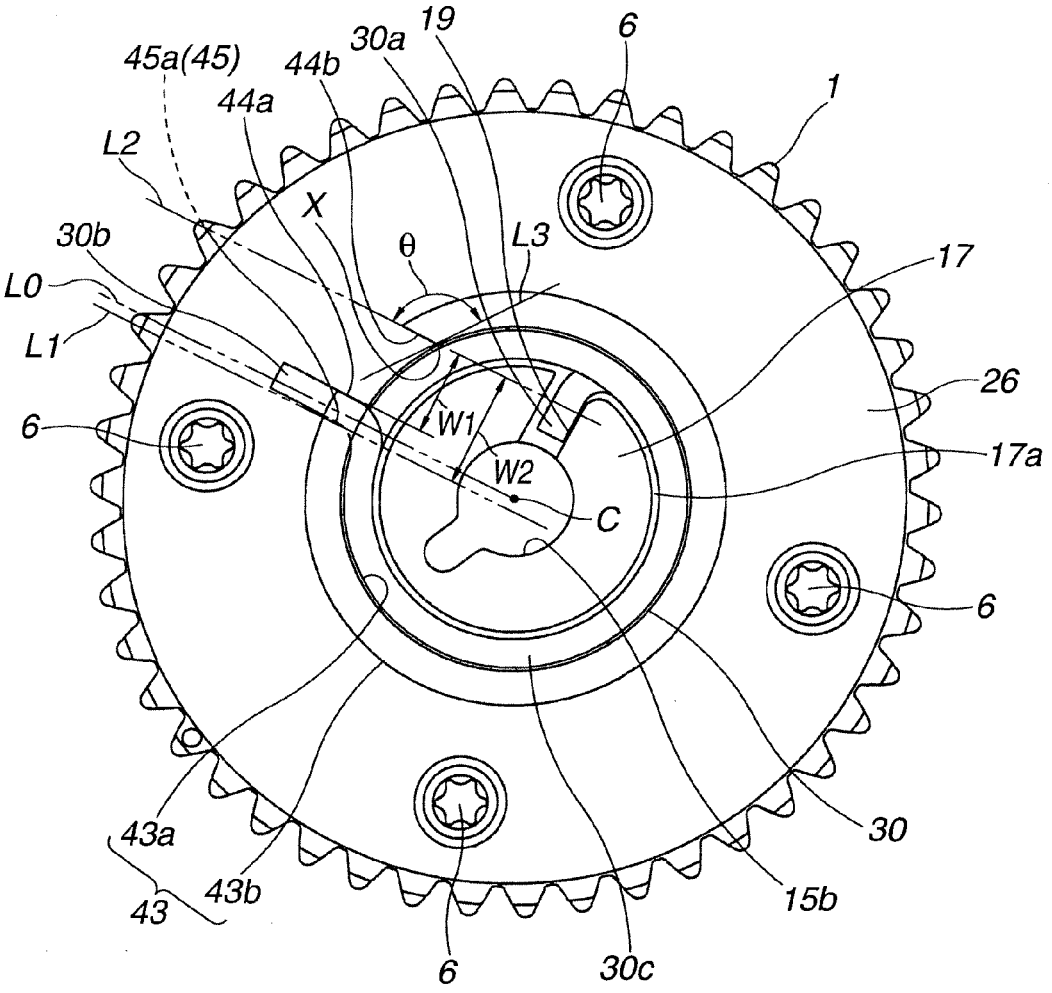
FIG. 2 is a front view of the valve timing control apparatus according to the embodiment of the present invention.
Figure 3:
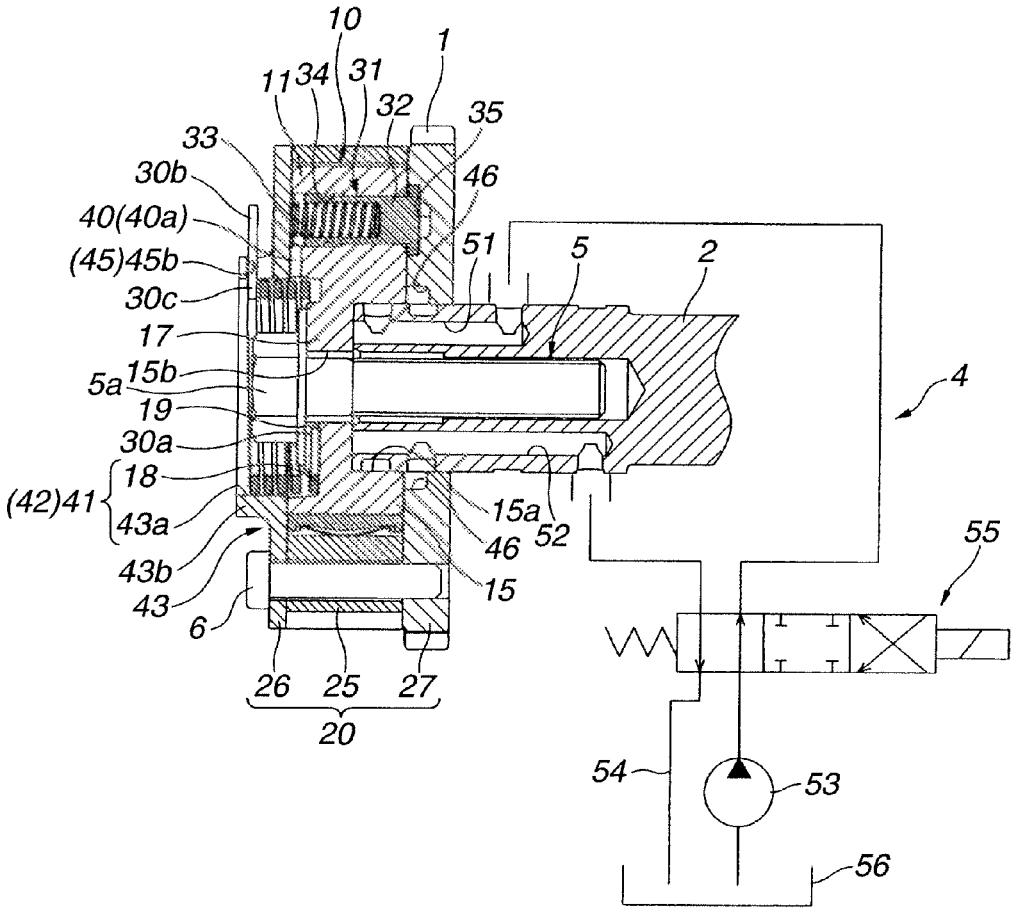
FIG. 3 is a vertical cross-section of the valve timing control apparatus shown in FIG. 2, which shows a lock mechanism and a torsion spring.

Referring to FIG. 1 to FIG. 9B, there is shown a valve timing control apparatus for an internal combustion engine, according to an embodiment of the present invention. As shown in FIG. 3, the valve timing control apparatus is disposed between sprocket 1 that is rotationally driven by a rotational force of a crankshaft of the engine, and camshaft 2 disposed to be rotatable relative to sprocket 1. The valve timing control apparatus is operationally controlled through hydraulic supply-discharge section 4, and serves to vary a relative rotational phase of sprocket 1 and camshaft 2.

Figure 4:
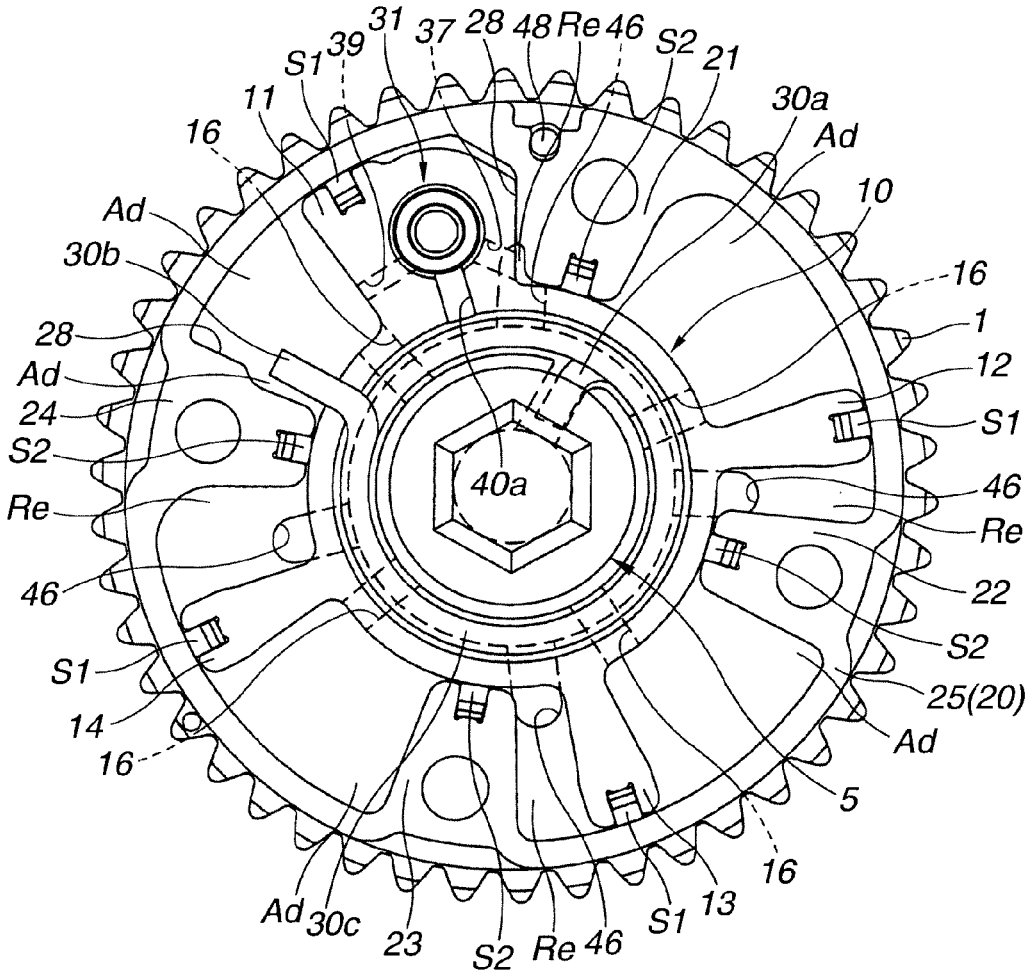
FIG. 4 is a view of an inside of the valve timing control apparatus shown in FIG. 2, which shows a vane rotor held in a phase-advance position.
Figure 5:
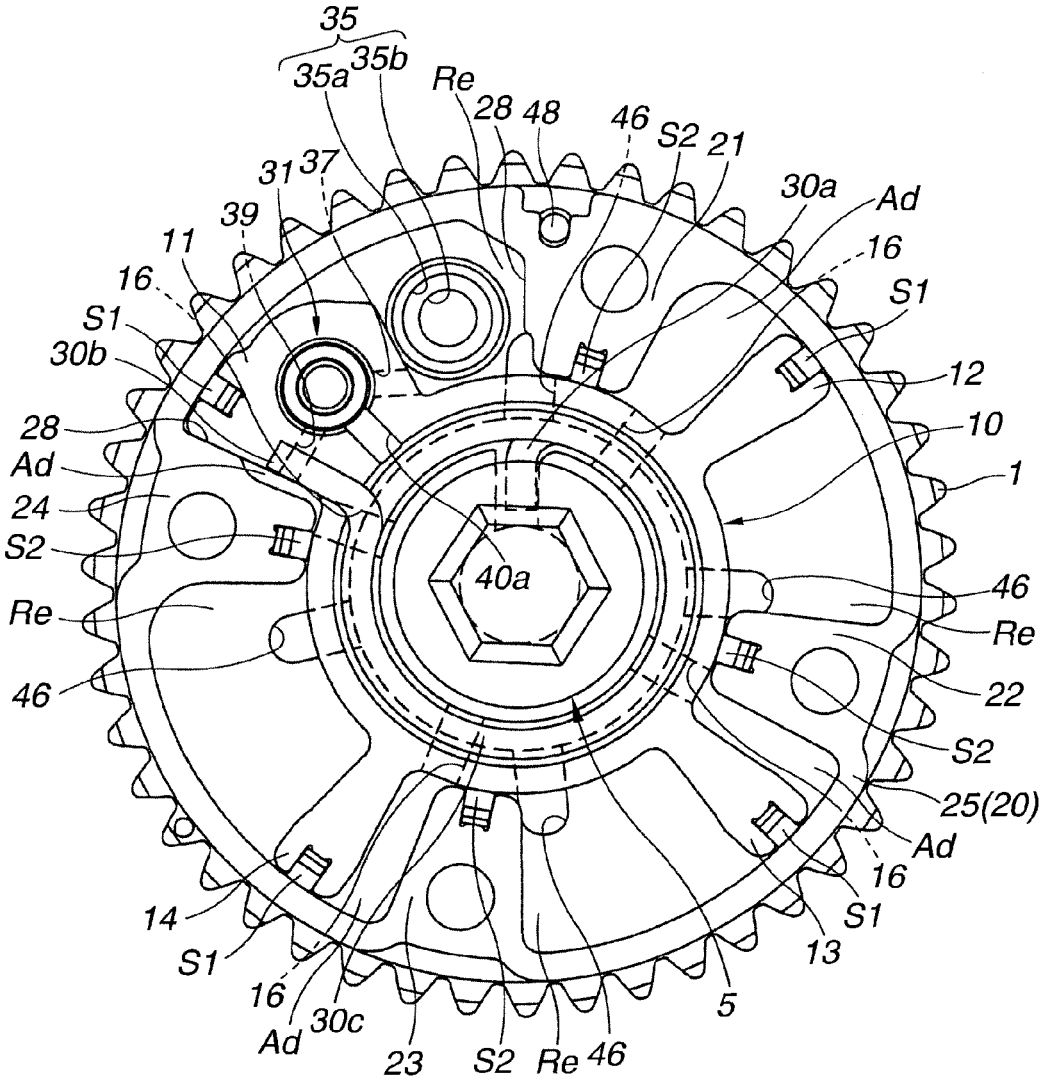
FIG. 5 is a view of an inside of the valve timing control apparatus shown in FIG. 2, which shows the vane rotor held in a phase-retard position.

Specifically, as shown in FIG. 3 to FIG. 5, the valve timing control apparatus includes vane rotor 10 fixed to one axial end portion of camshaft 2 so as to make unitary rotation with camshaft 2, and generally cylindrical housing (a drive rotation member) 20 formed integrally with sprocket 1 and accommodating vane rotor 10. As shown in FIG. 4 and FIG. 5, vane rotor 10 includes cylindrical rotor body 15 and a plurality of vanes (in this embodiment, four vanes 11-14) that project on an outer periphery of rotor body 15 and are spaced apart from each other in a circumferential direction of rotor body 15. Housing 20 is disposed on an outer peripheral side of vane rotor 10 and rotatable relative to vane rotor 10. Housing 20 includes a plurality of shoes (in this embodiment, four shoes 21-24 corresponding to vanes 11-14 in number) which project on an inner periphery of housing 20 and are spaced apart from each other in a circumferential direction of housing 20. A pair of phase-advance hydraulic chamber Ad and phase-retard hydraulic chamber Re are defined between each of vanes 11-14 and two of shoes 21-24 located adjacent to the vane in the circumferential direction of rotor body 15. The valve timing control apparatus is operationally controlled by selectively supplying hydraulic pressure from hydraulic supply-discharge section 4 to phase-retard hydraulic chamber Re and phase-advance hydraulic chamber Ad.

Figure 7A:
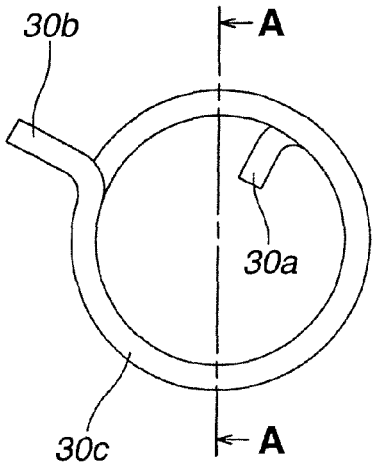
FIG. 7A is a front view of the torsion spring shown in FIG. 3.
Figure 7B:
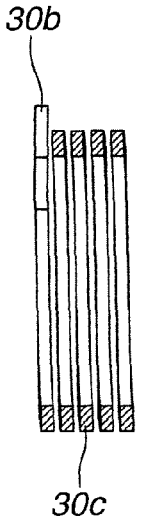
FIG. 7B is a cross-section taken along line A-A shown in FIG. 7A.

As shown in FIG. 2 to FIG. 3, torsion spring 30 is disposed between vane rotor 10 and housing 20. Torsion spring 30 has one end 30*a* fixed to vane rotor 10, and the other end 30*b* fixed to housing 20, and biases vane rotor 10 toward a phase-advance side. With the biasing force of torsion spring 30, vane rotor 10 is urged toward the phase-advance side against so-called alternate torque corresponding to a rotational force acting in a phase-retard direction which is transmitted through camshaft 2 to vane rotor 10, at the time immediately before stop of the engine in which either phase-retard hydraulic chamber Re or phase-advance hydraulic chamber Ad becomes free from hydraulic pressure. In this embodiment, torsion spring 30 is a coiled wire spring formed by winding a piece of wire having a generally rectangular shape in cross-section, specifically, a rectangular shape in cross-section which has long opposite sides in a radial direction of torsion spring 30 as shown in FIG. 7B. By using such a coiled wire spring as torsion spring 30, an axial length of torsion spring 30 can be reduced, thereby serving to downsize the valve timing control apparatus in an axial direction thereof.

As shown in FIG. 3, vane rotor 10 is fitted onto the one axial end portion of camshaft 2 through fitting portion 15*a* of rotor body 15. Fitting portion 15*a* is a concaved portion formed in one axial end surface of rotor body 15 which is located on a side of camshaft 2. Vane rotor 10 is fixed to camshaft 2 through cam bolt 5 inserted into insertion hole 15*b* extending through a central portion of rotor body 15, so that vane rotor 10 can make unitary rotation with camshaft 2. When vane rotor 10 that is thus synchronously rotated with camshaft 2 is rotated relative to housing 20, a rotational phase of camshaft 2 relative to the crankshaft is varied to thereby change timings of opening and closing the engine valve.

As shown in FIG. 4 and FIG. 5, rotor body 15 includes a plurality of communication holes (in this embodiment, four communication holes) 16 formed in a position adjacent to a root end portion of each of vanes 11-14 in the circumferential direction of rotor body 15. Each of communication holes 16 extends in a radial direction of rotor body 15 to communicate each of phase-advance hydraulic chamber Ad with each of hydraulic passages 51, 52 formed in camshaft 2 as shown in FIG. 3. A working oil is supplied through each of hydraulic passages 51, 52 by hydraulic supply-discharge section 4, and introduced into each of phase-advance hydraulic chamber Ad through each of communication holes 16.

As shown in FIG. 1 to FIG. 5, rotor body 15 also includes cylindrical bolt seat portion 17 formed on a side of the other axial end of rotor body 15 which is opposed to front plate 26 as explained later, and spring seat portion 18 formed on an outer peripheral side of bolt seat portion 17. Bolt seat portion 17 is disposed on an outer peripheral side of insertion hole 15*b*. Bolt seat portion 17 has a flat annular surface as a seat for cam bolt 5 at an axial end thereof. Bolt seat portion 17 has an outer diameter slightly smaller than an inner diameter of spring portion (winding portion) 30*c* of torsion spring 30 such that spring portion 30*c* is fitted onto an outer periphery of bolt seat portion 17. Bolt seat portion 17 has chamfered portion 17*a* in an outer peripheral edge of the axial end portion thereof as shown in FIG. 2. Chamfered portion 17*a* has a conical shape or an arcuate vertical cross-section, and continuously extends in a circumferential direction of bolt seat portion 17. Chamfered portion 17*a* serves to prevent spring portion 30*c* from bumping on bolt seat portion 17 when spring portion 30*c* is moved in an axial direction of torsion spring 30 upon application of torque to torsion spring 30. Spring seat portion 18 is in the form of an annular groove, and serves as a seat for a part of spring portion 30*c* which is located on a side of one end portion 30*a*.

In addition, bolt seat portion 17 has first engaging portion 19 in the end surface thereof which serves to engage and fix one end portion 30*a* of torsion spring 30. First engaging portion 19 is in the form of a groove or cutout which extends along a radial direction of bolt seat portion 17 and is opened to the axial end surface of bolt seat portion 17. First engaging portion 19 is connected with spring seat portion 18 without forming a step therebetween, and extends through bolt seat portion 17 to communicate spring seat portion 18 and insertion hole 15*b*. One end portion 30*a* of torsion spring 30 is radially inwardly bent relative to spring portion 30*c*, that is, extends from the outer peripheral side of bolt seat portion 17 toward a central portion thereof, so that one end portion 30*a* is engaged with first engaging portion 19 and fixed to rotor body 15. First engaging portion 19 is overlapped with head 5*a* of cam bolt 5 in an axial direction of bolt seat portion 17 such that an axial opening of first engaging portion 19 is substantially closed by head 5*a* to thereby prevent one end portion 30*a* of torsion spring 30 from falling off from first engaging portion 19. By thus using head 5*a* of cam bolt 5 as an existing part, one end portion 30*a* of torsion spring 30 can be fixed to rotor body 15 without using any other fastening member. As a result, an operating efficiency of an assembly work of the valve timing control apparatus can be enhanced, and the cost can be reduced.

As shown in FIG. 1, FIG. 4 and FIG. 5, each of vanes 11-14 has seal member S1 on an outer peripheral tip end portion thereof. Seal member S1 extends in a thickness direction of each of vanes 11-14, i.e., in an axial direction of rotor body 15. Seal member S1 come into slide contact with an inner peripheral surface of housing 20, so that a hydraulic chamber defined between respective adjacent two of shoes 21-24 in the circumferential direction of housing 20 is divided into phase-advance hydraulic chamber Ad and phase-retard hydraulic chamber Re. Among these vanes 11-14, only vane 11 has a width larger than that of the remaining vanes 12-14 in the circumferential direction of rotor body 15. When vane rotor 10 is rotationally moved to be in a maximum rotational position relative to housing 20, wide vane 11 is abutted on each of shoes 21, 24 adjacent thereto, thereby restricting further rotation of vane rotor 10. Accommodated within wide vane 11 is lock mechanism 31 that serves to retain a rotational phase of vane rotor 10 when the engine is stopped as explained later.

As shown in FIG. 3 to FIG. 6, lock mechanism 31 includes generally cylindrical lock pin 32 disposed in pin accommodating hole 34 of wide vane 11, and spring (a biasing member) 33 disposed between lock pin 32 and front plate 26. Lock pin 32 is slidably disposed in pin accommodating hole 34 that extends through wide vane 11 in the axial direction of rotor body 15. Lock pin 32 is brought into engagement in pin engaging hole 35 formed in rear plate 27 of housing 20 as explained later, so that the rotational movement of vane rotor 10 relative to housing 20 can be restrained. Spring 33 biases lock pin 32 toward a side of rear plate 27.

Figure 6:
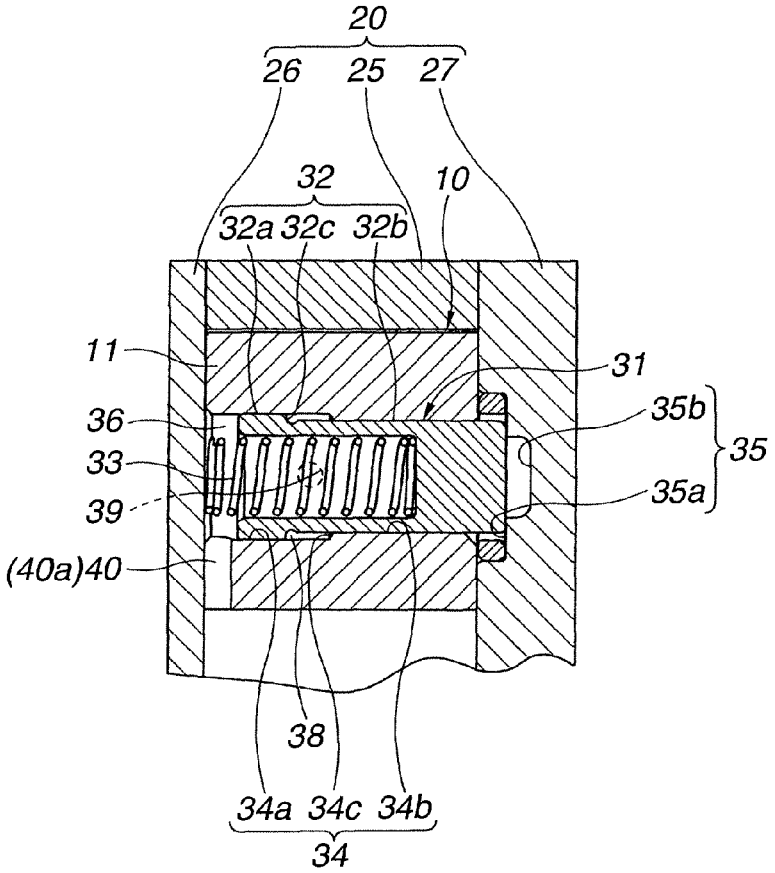
FIG. 6 is an enlarged diagram showing an essential part of the lock mechanism shown in FIG. 3.

Specifically, as shown in FIG. 1 and FIG. 6, lock pin 32 is formed such that a diameter thereof is stepwise reduced toward a tip end thereof (toward the side of rear plate 27). Similarly, pin accommodating hole 34 is formed such that a diameter thereof is stepwise reduced toward the side of rear plate 27. As shown in FIG. 6, lock pin 32 includes large-diameter portion 32*a* on the side of front plate 26, small-diameter portion 32*b* on the side of rear plate 27, and step portion 32*c* between large-diameter portion 32*a* and small-diameter portion 32*b*. Large-diameter portion 32*a* is slidably received in large-diameter portion 34*a* of pin accommodating hole 34 which is located on the side of front plate 26. Small-diameter portion 32*b* is slidably received in small-diameter portion 34*b* of pin accommodating hole 34 which is located on the side of rear plate 27. Spring 33 is installed in a spring mount hole formed in lock pin 32. One end of spring 33 is supported on a bottom of the spring mount hole, and the other end thereof is supported on one end surface (a rear surface) of front plate 26 which is opposed to wide vane 11. Back pressure chamber 36 is defined within large-diameter portion 34*a* of pin accommodating hole 34 between front plate 26 and lock pin 32. The other end portion of spring 33 is exposed to back pressure chamber 36. Pin engaging hole 35 of rear plate 27 is connected with communication groove 37 formed in one end surface (a rear surface) of wide vane 11 which is opposed to rear plate 27. The hydraulic pressure in phase-retard hydraulic chamber Re is introduced into pin engaging hole 35 through communication groove 37 shown in FIG. 1. With the provision of communication groove 37, lock pin 32 can be brought into engagement in pin engaging hole 35 and disengagement therefrom in accordance with the hydraulic pressure in phase-retard hydraulic chamber Re.

As shown in FIG. 6, annular space 38 is formed between step portion 32*c* of lock pin 32 and step portion 34*c* of pin accommodating hole 34 which is formed between large-diameter portion 34*a* and small-diameter portion 34*b*, and extends in an axial direction of lock pin 32. Annular space 38 is communicated with phase-advance hydraulic chamber Ad through through hole 39 that extends through wide vane 11 to be opened to phase-advance hydraulic chamber Ad. The hydraulic pressure in phase-advance hydraulic chamber Ad is introduced into annular space 38 through through hole 39. With the provision of through hole 39, when the hydraulic pressure in phase-advance hydraulic chamber Ad becomes higher than a predetermined pressure value, lock pin 32 can be held in a disengagement state in which lock pin 32 is disengaged from pin engaging hole 35.

Communication groove 40*a* is formed in the other end surface (a front surface) of wide vane 11 which is opposed to front plate 26. Communication groove 40*a* is opened to pin accommodating hole 34 at one end thereof, and is opened to spring seat portion 18 of rotor body 15 at an opposite end thereof, thereby serving to establish fluid communication between pin accommodating hole 34 and spring seat portion 18. Communication groove 40*a* is closed by front plate 26, and serves as back pressure relief passage 40. Back pressure relief passage 40 serves to discharge the working oil that is leaked toward back pressure chamber 36 through a fine radial clearance between an outer peripheral surface of large-diameter portion 32*a* of lock pin 32 and an inner peripheral surface of large-diameter portion 34*a* of pin accommodating hole 34. Back pressure relief passage 40 is formed in a position in a circumferential direction of vane rotor 10 in which back pressure relief passage 40 crosses mutual contact portion T of windings of spring portion 30*c* (see FIG. 8) at which mutual contact between windings of spring portion 30*c* is caused when vane rotor 10 is rotated by a maximum angle relative to housing 20. Mutual contact portion T of windings of spring portion 30*c* will be hereinafter referred to as winding contact portion T of spring portion 30*c*. With the arrangement of back pressure relief passage 40, the working oil discharged through back pressure relief passage 40 can be flowed to winding contact portion T. Specifically, the circumferential position in which back pressure relief passage 40 crosses winding contact portion T of spring portion 30*c* means a position in the circumferential direction of vane rotor 10 which is offset from a position in which the other end portion 30*b* of torsion spring 30 is fixed, by an angle of substantially 90 degrees in a direction opposite to a torsional direction of torsion spring 30 (see FIG. 4 and FIG. 5).

Further, preferably, back pressure relief passage 40 is arranged in a circumferential position in which back pressure relief passage 40 crosses a maximum contact portion in which an outer periphery of spring portion 30*c* and an inner periphery of spring guide 41 as explained later are contacted with each other at a maximum intensity due to inclination of spring portion 30*c* which is caused when vane rotor 10 is rotated by a maximum angle relative to housing 20 (see FIG. 8). With this arrangement, the working oil discharged through back pressure relief passage 40 can be also flowed to the maximum contact portion between spring portion 30*c* and spring guide 41.

As shown in FIG. 1 to FIG. 5, housing 20 includes generally cylindrical housing body 25 having shoes 21-24 on an inner peripheral side thereof, front plate 26 that closes a front open end of housing body 25, and rear plate 27 that closes a rear open end of housing body 25. Front plate 26 and rear plate 27 are fixed to housing body 25 in an axial direction of housing body 25 through four bolts 6, so that housing body 25 and front and rear plates 26, 27 are formed as an integral housing 20.

As shown in FIG. 4 and FIG. 5, seal member S2 is disposed on a peripheral tip end portion of each of shoes 21-24. Seal member S2 extends in a thickness direction of the each of shoes 21-24. Seal members S2 come into slide contact with an outer peripheral surface of rotor body 15 of vane rotor 10, thereby defining hydraulic chambers Ad, Re between respective adjacent two of shoes 21-24 and each of vanes 11-14 disposed between the adjacent two of shoes 21-24. Among shoes 21-24, a pair of shoes 21, 24 adjacent to wide vane 11 have build-up portions 28, 28 on side surfaces that are opposed to wide vane 11 in the circumferential direction of housing body 25. Each of build-up portions 28, 28 is formed on a side of a root end of each of shoes 21, 24 (that is, on a radial outer side of each of shoes 21, 24). When vane rotor 10 is rotated by the maximum angle relative to housing 20, build-up portions 28, 28 abut against wide vane 11 to restrict further rotation of vane rotor 10 while ensuring hydraulic chambers Ad, Re between wide vane 11 and shoes 21, 24.

As shown in FIG. 1 to FIG. 3, front plate 26 has a generally annular disk shape having a relatively small thickness. Front plate 26 includes cylindrical sleeve portion 43 projecting from a central portion of the other end surface (a front surface) of front plate 26. Sleeve portion 43 outwardly extends from a periphery of a central hole of front plate 26 so that axial bore 43*a* of sleeve portion 43 is communicated with the central hole. By inserting cam bolt 5 and torsion spring 30 from an outside into axial bore 43*a* of sleeve portion 43, cam bolt 5 can be assembled to camshaft 2, and torsion spring 30 can be assembled to vane rotor 10 as shown in FIG. 9A and FIG. 9B. As best shown in FIG. 8, sleeve portion 43 has an inner diameter substantially equal to an outer diameter of spring seat portion 18 of vane rotor 10. Sleeve portion 43 is in alignment with spring seat portion 18 in the axial direction of vane rotor 10. Sleeve portion 43 cooperates with spring seat portion 18 to form an inner peripheral surface that continuously and substantially smoothly extends to serve as spring guide 41. Further, sleeve portion 43 cooperates with spring seat portion 18 to form spring accommodating portion 42 in which spring portion 30*c* of torsion spring 30 is accommodated, on an inner peripheral side of spring guide 41. With this construction, spring portion 30*c* of torsion spring 30 is accommodated within spring accommodating portion 42 such that spring portion 30*c* can be smoothly moved in the axial direction of torsion spring 30 by spring guide 41. Accordingly, when torque is applied to torsion spring 30, smooth deformation of spring portion 30*c* can be ensured.

As shown in FIG. 1 and FIG. 2, cutout portion 44 is formed in axial end portion (front end portion) 43*b* of sleeve portion 43 by cutting a part of a circumferential wall of sleeve portion 43. Cutout portion 44 extends through the part of the circumferential wall of sleeve portion 43 in parallel to a radial direction of sleeve portion 43 over a predetermined angular range in a circumferential direction of sleeve portion 43. Cutout portion 44 includes one side wall surface 44*a* and the other side wall surface 44*b* opposed to one side wall surface 44*a* in a circumferential direction of sleeve portion 43. Cutout portion 44 also includes second engaging portion 45 that serves to engage the other end portion 30*b* of torsion spring 30. Second engaging portion 45 is formed by cutting a part of one side wall surface 44*a* which is located on an axial inside of one side wall surface 44*a*, along the circumferential direction of sleeve portion 43.

The construction of cutout portion 44 is now explained in detail. As shown in FIG. 2, one side wall surface 44*a* and the other side wall surface 44*b* opposed to one side wall surface 44*a* in substantially parallel relation thereto. Second engaging portion 45 includes end wall surface 45*a* opposed to the other side wall surface 44*b* in the circumferential direction of sleeve portion 43, and axial end-side circumferential wall surface 45*b* disposed between end wall surface 45*a* and one side wall surface 44*a*. The other end portion 30*b* of torsion spring 30 is engaged with end wall surface 45*a*. Further, straight line L1 extending through end wall surface 45*a* toward an inner peripheral side of sleeve portion 43 is located closer to central axis C of sleeve portion 43 than straight line L2 extending through the other side wall surface 44*b* toward the inner peripheral side of sleeve portion 43 such that straight line L1 extends close to central axis C of sleeve portion 43 or substantially extends across central axis C of sleeve portion 43. Specifically, cutout portion 44 is formed in such a position that end wall surface 45*a* is located closer to straight line L0 extending across central axis C of sleeve portion 43 than the other side wall surface 44*b*, by cutting axial end portion 43*b* of the circumferential wall of sleeve portion 43 along the radial direction of sleeve portion 43 by a punch having a predetermined width. With this construction of cutout portion 44, the other side wall surface 44*b* makes an obtuse angle θ relative to tangent L3 to an inner peripheral surface of sleeve portion 43 as shown in FIG. 2.

Further, second engaging portion 45 is formed into a groove shape by cutting a part of one side wall surface 44*a* of cutout portion 44 such that a circumferential width of cutout portion 44 on the side of the axial end of sleeve portion 43 becomes stepwise smaller than a circumferential width of cutout portion 44 on a side of an opposite axial end of sleeve portion 43. In other words, as shown in FIG. 2, second engaging portion 45 is formed such that distance W1 between one side wall surface 44*a* and the other side wall surface 44*b* of cutout portion 44 becomes stepwise smaller than distance W2 between end wall surface 45*a* and the other side wall surface 44*b*. Axial end-side circumferential wall surface 45*b* of second engaging portion 45 extends by a difference between distances W1 and W2 along the circumferential direction of sleeve portion 43 to thereby form a step between one side wall surface 44*a* and end wall surface 45*a*. Axial end-side circumferential wall surface 45*b* serves as a stop to restrict displacement of the other end portion 30*b* of torsion spring 30 in the axial direction of torsion spring 30 and prevent fall off of torsion spring 30 from spring accommodating portion 42. With the arrangement of axial end-side circumferential wall surface 45*b*, torsion spring 30 can be stably retained in spring accommodating portion 42.

As shown in FIG. 1 and FIG. 3, rear plate 27 has a generally disk shape, and is provided with integrally formed sprocket 1 on an outer periphery thereof. Rear plate 27 has insertion hole 27*a* at a central portion thereof through which camshaft 2 extends, and has threaded holes 27*b* on an radial-outer side thereof into which bolts 6 are screwed. A plurality of communication holes (in this embodiment, four communication holes) 46 are formed in an end surface (a front surface) of rear plate 27 which is opposed to vane rotor 10. Communication holes 46 extend from a peripheral edge of insertion hole 27*a* in a radially outward direction of rear plate 27. Communication holes 46 serve to communicate respective hydraulic phase-retard hydraulic chambers Re with hydraulic passages 51, 52 formed in camshaft 2. The working oil supplied through hydraulic passages 51, 52 by hydraulic supply-discharge section 4 can be introduced into respective hydraulic phase-retard hydraulic chambers Re through communication holes 46.

Further, rear plate 27 has pin engaging hole 35 on the end surface (the front surface) in which lock pin 32 is engaged to restrain rotation of vane rotor 10 when vane rotor 10 is placed in a maximum phase-advance position. Specifically, as shown in FIG. 6, pin engaging hole 35 is stepwise reduced in diameter along a depth direction thereof, and is constituted of large-diameter hole 35*a* having a diameter larger than an outer diameter of a tip end portion of lock pin 32, and small-diameter hole 35*b* having a diameter smaller than the outer diameter of the tip end portion of lock pin 32. When vane rotor 10 is placed in the maximum phase-advance position, large-diameter hole 35*a* is engaged with lock pin 32 to thereby prevent vane rotor 10 from being rotated relative to housing 20.

In addition, as shown in FIG. 1, FIG. 4 and FIG. 5, rear plate 27 has positioning pin 48 on the end surface (the front surface). Positioning pin 48 is engaged in engaging groove 47 formed in an outer peripheral portion of housing body 25. Positioning pin 48 serves for positioning of rear plate 27 relative to housing body 25 upon assembling rear plate 27 to housing body 25, so that engagement between lock pin 32 and pin engaging hole 35 in the maximum phase-advance position of vane rotor 10 can be ensured.

As shown in FIG. 3, hydraulic supply-discharge section 4 is configured to selectively supply hydraulic pressure to respective hydraulic chambers Ad, Re and discharge hydraulic pressure in respective hydraulic chambers Ad, Re therefrom. Hydraulic supply-discharge section 4 includes phase-retard side hydraulic passage 51 connected to communication holes 46, phase-advance side hydraulic passage 52 connected to communication holes 16, oil pump 53 as a hydraulic power source serving to supply hydraulic pressure to one of hydraulic passages 51, 52 through electromagnetic valve 55, and drain passage 54 connected to the other of hydraulic passages 51, 52 which is not connected to oil pump 53 through electromagnetic valve 55. Electromagnetic valve 55 is a two-directional control valve, and is controlled to selectively carry out changeover of connection between hydraulic passages 51, 52 and oil pump 53 and connection between hydraulic passages 51, 52 and drain passage 54 in response to a control signal from electronic controller (ECU), not shown.

An operation of the valve timing control apparatus for an internal combustion engine, according to the embodiment will be explained by referring to FIG. 3 to FIG. 5.

At the time at which the engine is started, as shown in FIG. 3 and FIG. 4, the tip end portion of lock pin 32 is held in engagement in large-diameter hole 35*a* of pin engaging hole 35 so that vane rotor 10 is retained in a predetermined phase-advance position most suitable for starting the engine. In this condition, an ignition switch is turned on to perform smooth cranking and good start of the engine.

Subsequently, in a predetermined load range after the start of the engine, electromagnetic valve 55 is energized in response to a control signal from the ECU (not shown), so that phase-retard side hydraulic passage 51 is communicated with oil pump 53, and phase-advance side hydraulic passage 52 is communicated with drain passage 54. That is, the working oil discharged from oil pump 53 is supplied to respective phase-retard hydraulic chambers Re through phase-retard side hydraulic passage 51, so that hydraulic pressure in respective phase-retard hydraulic chambers Re becomes high. On the other hand, the working oil in respective phase-advance hydraulic chambers Ad is discharged to oil pan 56 through phase-advance side hydraulic passage 52 and drain passage 54, so that hydraulic pressure in respective phase-advance hydraulic chambers Ad becomes low. At this time, the working oil supplied to respective phase-retard hydraulic chambers Re is flowed into pin engaging hole 35 and urges lock pin 32 to be disengaged from pin engaging hole 35 to thereby allow free rotation of vane rotor 10. As a volume of respective phase-retard hydraulic chambers Re is increased with the hydraulic supply to respective phase-retard hydraulic chambers Re, vane rotor 10 is rotated in a counterclockwise direction as shown in FIG. 5. As a result, a rotational phase of camshaft 2 relative to the crankshaft is varied to the phase-retard side.

On the other hand, when the predetermined load range is shifted to the other load range, energization of electromagnetic valve 55 is interrupted in response to a control signal from the ECU, so that phase-advance side hydraulic passage 52 is communicated with oil pump 53, and phase-retard side hydraulic passage 51 is communicated with drain passage 54. That is, the working oil in respective phase-retard hydraulic chambers Re is discharged into oil pan 56 through phase-retard side hydraulic passage 51 and drain passage 54, so that hydraulic pressure in respective phase-retard hydraulic chambers Re becomes low. In contrast, the working oil discharged from oil pump 53 is supplied to respective phase-advance hydraulic chambers Ad through phase-advance side hydraulic passage 52, so that hydraulic pressure in respective phase-advance hydraulic chambers Ad becomes high. At this time, the hydraulic pressure in respective phase-advance hydraulic chambers Ad is introduced into annular space 38 between lock pin 32 and pin accommodating hole 34 through through hole 39 in accordance with the hydraulic supply to respective phase-advance hydraulic chambers Ad. With the hydraulic pressure introduced into annular space 38, lock pin 32 is held in a state disengaged from pin engaging hole 35. As a volume of respective phase-advance hydraulic chambers Ad is increased with the hydraulic supply to respective phase-advance hydraulic chambers Ad, vane rotor 10 is rotated in a clockwise direction as shown in FIG. 4. As a result, a rotational phase of camshaft 2 relative to the crankshaft is varied to the phase-advance side.

At the time immediately before stop of the engine, the hydraulic supply to respective phase-advance hydraulic chambers Ad and respective phase-retard hydraulic chambers Re is terminated, and vane rotor 10 is likely to rotate toward the phase-retard side due to alternate torque applied to camshaft 2. However, as shown in FIG. 4, vane rotor 10 is allowed to rotate toward the phase-advance side against the alternate torque by the biasing force of torsion spring 30 which is exerted on vane rotor 10. Then, lock pin 32 is allowed to move into pin engaging hole 35 such that the tip end portion of lock pin 32 is engaged in large-diameter hole 35*a* by the biasing force of spring 33. Vane rotor 10 is thus held in the predetermined phase-advance position.

The valve timing control apparatus according to the embodiment can attain the following functions and effects. As described above, free rotation of vane rotor 10 can be ensured or maintained by supplying the hydraulic pressure to pin engaging hole 35 and annular space 38 between lock pin 32 and pin accommodating hole 34. The hydraulic pressure supplied to pin engaging hole 35 and annular space 38 is leaked or flowed toward back pressure chamber 36 through the fine radial clearance between the outer peripheral surface of lock pin 32 and the inner peripheral surface of pin accommodating hole 34, and is discharged from back pressure chamber 36 into spring accommodating portion 42 through back pressure relief passage 40.

As described above, back pressure relief passage 40 is formed in the position in the circumferential direction of vane rotor 10 in which back pressure relief passage 40 crosses winding contact portion T of spring portion 30*c* of torsion spring 30 which is caused when vane rotor 10 is rotated by the maximum angle relative to housing 20. Accordingly, the working oil discharged through back pressure relief passage 40 is supplied to winding contact portion T, thereby lubricating the windings of spring portion 30*c* in winding contact portion T. As a result, wear caused between the windings of spring portion 30*c* in winding contact portion T can be suppressed to thereby enhance durability and reliability of the valve timing control apparatus according to the embodiment.

Further, as described above, the coiled wire spring formed by winding a piece of wire having a generally rectangular cross-section is used as torsion spring 30. In this case, when a rotational load (torque) is applied to torsion spring 30, spring portion 30*c* tends to be inclined in the axial direction of torsion spring 30 so that contact between the windings of spring portion 30*c* will be more frequently caused. However, even in such a case, spring portion 30*c* can be more effectively lubricated by supplying the working oil to winding contact portion T as described above. Particularly, in this embodiment, torsion spring 30 is a coiled wire spring formed of a piece of wire having a generally rectangular shape in cross-section which has long opposite sides in a radial direction of the coiled wire spring. In such a case, inclination of spring portion 30*c* in the axial direction of torsion spring 30 becomes still larger. Even in this case, lubrication of spring portion 30*c* can be more effectively carried out by supplying the working oil to winding contact portion T as described above.

Further, when the working oil is introduced into annular space 38 between lock pin 32 and pin accommodating hole 34 which is located adjacent to back pressure chamber 36, the working oil filled in the fine radial clearance between lock pin 32 and pin accommodating hole 34 tends to leak more frequently. Therefore, a sufficient amount of the working oil can be supplied to spring accommodating portion 42 through back pressure relief passage 40, so that good lubrication of winding contact portion T can be carried out.

Figure 8:
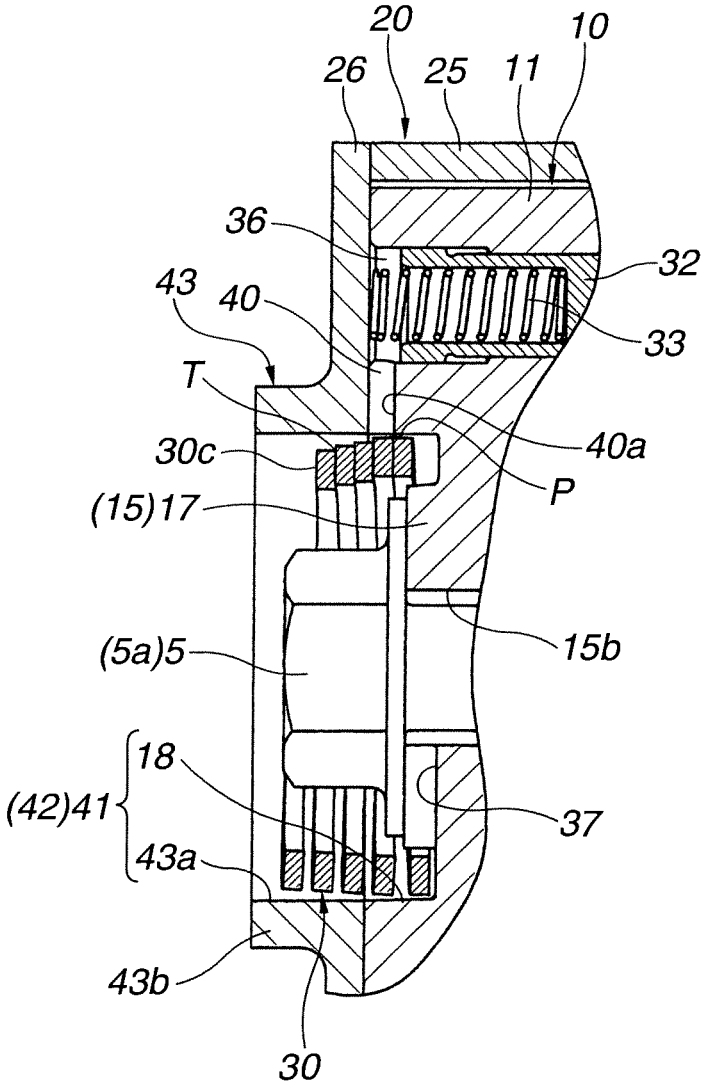
FIG. 8 is an enlarged view of an essential part of the valve timing control apparatus shown in FIG. 3, which shows an assembled state of the torsion spring.
Figure 9B:
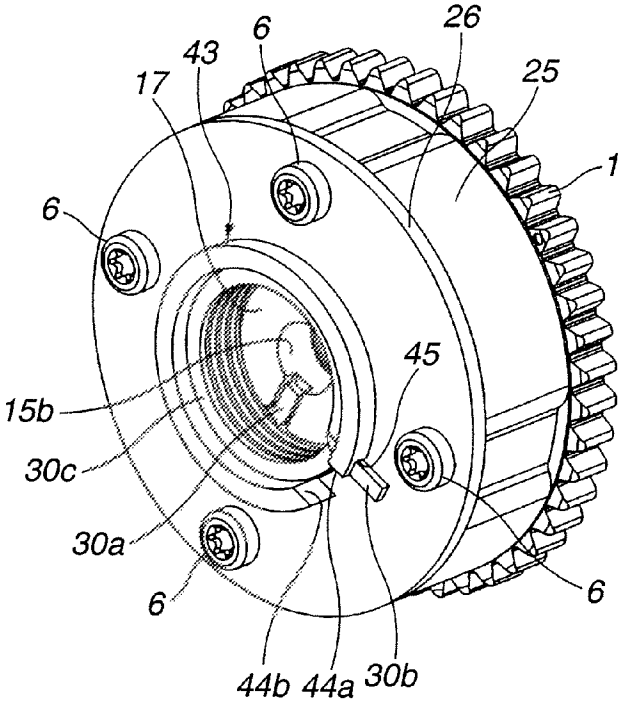
FIG. 9B is a perspective view of the valve timing control apparatus after the torsion spring shown in FIG. 3 is assembled.
Figure 9A:
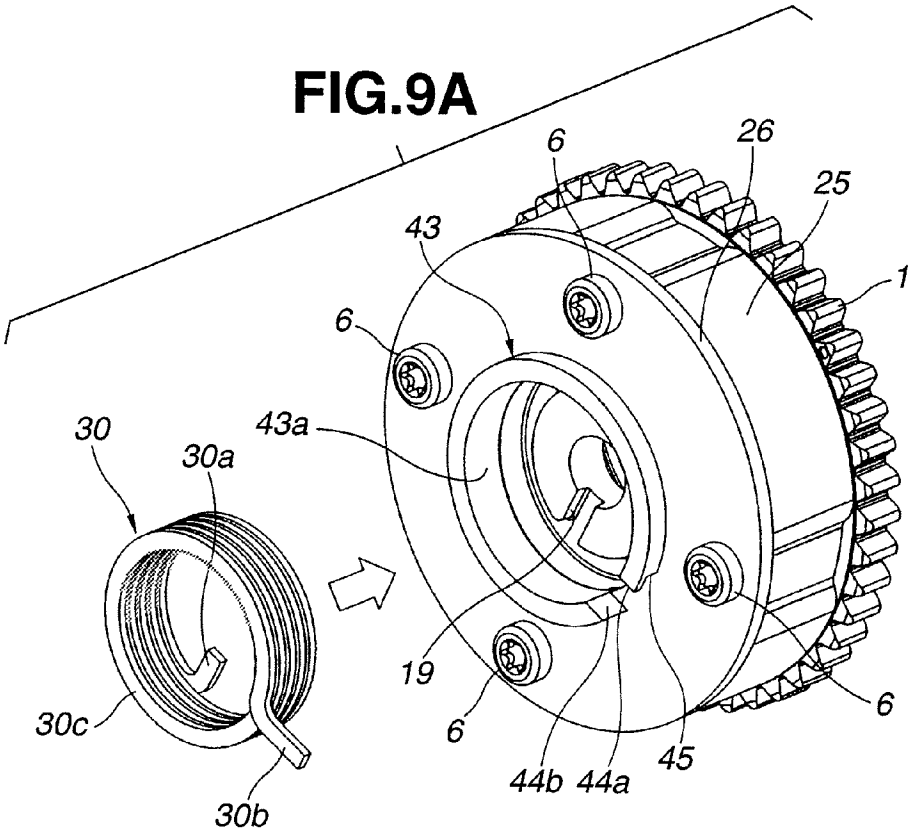
FIG. 9A is a perspective view of the valve timing control apparatus before the torsion spring shown in FIG. 3 is assembled.

Furthermore, when spring portion 30*c* of torsion spring 30 is inclined due to torque applied thereto, spring portion 30*c* is pressed against an inner peripheral surface of spring guide 41 as shown in FIG. 8. However, back pressure relief passage 40 is opened to the inner peripheral surface of spring guide 41, and therefore, the working oil discharged through back pressure relief passage 40 can be also supplied to pressed portion P of the inner peripheral surface of spring guide 41. As a result, it is possible to effectively lubricate pressed portion P to reduce frictional wear that is caused in pressed portion P.

In addition, when spring portion 30*c* of torsion spring 30 is inclined relative to the inner peripheral surface of spring guide 41, spring portion 30*c* undergoes a largest pressing force at corner portion X located on an inner peripheral edge of the other side wall surface 44*b* of cutout portion 44 as shown in FIG. 2. However, cutout portion 44 is formed in such a position that end wall surface 45*a* of second engaging portion 45 is located closer to straight line L0 extending across central axis C of sleeve portion 43 than the other side wall surface 44*b*, by cutting axial end portion 43*b* of the circumferential wall of sleeve portion 43 along the radial direction of sleeve portion 43 by a punch having a predetermined width. In thus formed cutout portion 44, one side wall surface 44*a* and the other side wall surface 44*b* are located substantially parallel with each other. Further, straight line L1 extending through end wall surface 45*a* toward an inner peripheral side of sleeve portion 43 is located closer to central axis C of sleeve portion 43 than straight line L2 extending through the other side wall surface 44*b* toward the inner peripheral side of sleeve portion 43. In other words, the other side wall surface 44*b* makes an obtuse angle θ relative to tangent L3 to the inner peripheral surface of sleeve portion 43. As a result, corner portion X between the other side wall surface 44*b* and the inner peripheral surface of sleeve portion 43, against which spring portion 30*c* is pressed, is configured to make a non-sharp angle to spring portion 30*c*, that is, make an obtuse angle θ as shown in FIG. 2. With this configuration of cutout portion 44, it is possible to minimize damage or local wear in spring portion 30*c* which is caused upon pressing spring portion 30*c* against corner portion X.

Further, upon assembling torsion spring 30 to vane rotor 10 and front plate 26, firstly one end portion 30*a* of torsion spring 30 is fixedly engaged with first engaging portion 19 opened to the axial end surface (the front surface) of rotor body 15 which is exposed to the outside, through axial bore 43*a* of sleeve portion 43 of front plate 26. Next, the other end portion 30*b* of torsion spring 30 is fixedly engaged with second engaging portion 45 of cutout portion 44 opened to the axial end surface (the front surface) of front plate 26. Therefore, even after front plate 26 is assembled to housing 20, torsion spring 30 can be inserted from the outside into axial bore 43*a* of sleeve portion 43 of front plate 26 and assembled to vane rotor 10 and front plate 26. Accordingly, the valve timing control apparatus can be assembled without conducting such an inconvenient assembly work that parts are assembled against the biasing force of torsion spring 30 after assembling torsion spring 30 while vane rotor 10 and housing 20 are relatively rotated. The valve timing control apparatus can serve to enhance productivity thereof.

Furthermore, with the specific construction and arrangement of cutout portion 44 as described above, corner portion X between the other side wall surface 44*b* and the inner peripheral surface of sleeve portion 43 is formed at the non-sharp angle, i.e., at the obtuse angle as shown in FIG. 2. As a result, even when spring portion 30*c* of torsion spring 30 is inclined and pressed against corner portion X due to torque applied thereto, it is possible to avoid occurrence of damage or local wear in spring portion 30*c*.

In addition, back pressure relief passage 40 is opened into vicinity of the position in which spring portion 30*c* is pressed against spring guide 41, in other words, the position in which spring portion 30*c* is pressed against corner portion X between the other side wall surface 44*b* of cutout portion 44 and the inner peripheral surface of sleeve portion 43. Accordingly, the specific effect of the above construction with lubrication of winding contact portion T through back pressure relief passage 40, it is possible to more effectively reduce adverse influence such as damage or local wear in spring portion 30*c* which is caused upon pressing against corner portion X.

The present invention is not particularly limited to the above embodiment. For instance, back pressure relief passage 40 can be in the form of a through hole formed in vane 11 without opening to the other end surface (the front surface) of vane 11.

Further, the valve timing control apparatus according to the embodiment of the present invention has the following features and effects.

(a) Straight line L1 extending through end wall surface 45*a* toward the inner peripheral side of sleeve portion 43 substantially extends through central axis C of the sleeve portion 43. With this construction, upon assembling torsion spring 30, an amount of contraction of torsion spring 30 in the circumferential direction can be minimized to thereby enhance an operating efficiency of the assembly work of torsion spring 30.

(b) Cutout portion 44 comprises stop 45*b* to restrict displacement of the other end portion 30*b* of torsion spring 30 in the axial direction of torsion spring 30. With this construction, retention of torsion spring 30 can be enhanced to thereby serve to suppress fall off of torsion spring 30 from cutout portion 44.

(c) In the valve timing control apparatus as described in the above feature (b), cutout portion 44 has a first circumferential width on the side of the axial end of the sleeve portion 43 and a second circumferential width on a side of an opposite axial end of sleeve portion 43 which is larger than the first circumferential width, stop 45*b* extending by a difference between the first circumferential width and the second circumferential width.

(d) In the valve timing control apparatus as described in the above feature (c), stop 45*b* is disposed between one side wall surface 44*a* and end wall surface 45*a* to form a step therebetween.

(e) Torsion spring 30 is a coiled wire spring formed of a piece of wire having a generally rectangular shape in cross-section. With this construction, an axial length of torsion spring 30 can be reduced, thereby serving to downsize the valve timing control apparatus. Further, as compared to windings of a torsion spring have a circular shape, inclination of torsion spring 30 which is caused upon torque is applied thereto becomes large. Therefore, with the specific construction of cutout portion 44 (i.e., corner portion X with a non-sharp angle between the other side wall surface 44*b* and the inner peripheral surface of sleeve portion 43), an effect of reducing wear of torsion spring 30 can be more effectively attained.

(f) In the valve timing control apparatus as described in the above feature (e), windings of torsion spring 30 are substantially contacted with each other.

(g) One end portion 30*a* of torsion spring 30 is bent in the radially inward direction of torsion spring 30, and is fixedly engaged with first engaging portion (groove) 19 formed in the axial end surface of rotor body 15. With this construction, it is possible to restrict displacement of torsion spring 30 in the circumferential direction thereof and assembly torsion spring 30 from an outside in the axial direction of torsion spring 30.

(h) In the valve timing control apparatus as described in the above feature (g), one end portion 30*a* of torsion spring 30 is prevented from falling off from first engaging portion 19 by head 5*a* of cam bolt 5 that serves to fix vane rotor 10 to camshaft 2. By thus using an existing cam bolt 5, an operating efficiency of an assembly work of the valve timing control apparatus can be enhanced and the cost can be reduced without using any other fastening member for fixing one end portion 30*a* of torsion spring 30.

This application is based on a prior Japanese Patent Application No. 2012-196715 filed on Sep. 7, 2012. The entire contents of the Japanese Patent Application No. 2012-196715 are hereby incorporated by reference.

Although the invention has been described above by reference to a certain embodiment of the invention and modification of the embodiment, the invention is not limited to the embodiment and modification described above. Further variations of the embodiment and modification described above will occur to those skilled in the art in light of the above teachings. The scope of the invention is defined with reference to the following claims.

What is claimed is:

1. A valve timing control apparatus for an internal combustion engine, comprising:

a generally cylindrical housing body rotatable by a rotational force that is transmitted from a crankshaft of the engine to the housing body, the housing body being opened to at least one axial end thereof, the housing body having a plurality of shoes projecting on an inner periphery thereof to define a plurality of hydraulic chambers;

a vane rotor comprising a rotor body fixed to a camshaft, and a plurality of vanes projecting on an outer periphery thereof to divide the plurality of hydraulic chambers into phase-advance hydraulic chambers and phase-retard hydraulic chambers, the vane rotor being rotatable relative to the housing body toward a phase-advance side by supplying hydraulic pressure to the phase-advance hydraulic chambers and discharging hydraulic pressure from the phase-retard hydraulic chambers, the vane rotor being rotatable relative to the housing body toward a phase-retard side by supplying hydraulic pressure to the phase-retard hydraulic chambers and discharging hydraulic pressure from the phase-advance hydraulic chambers;

a front plate fixed to an axial end of the housing body, the front plate comprising a cylindrical sleeve portion that projects from a central portion of the front plate, and a cutout portion formed on a side of an axial end of the sleeve portion, the cutout portion extending through a circumferential wall of the sleeve portion in parallel to a radial direction of the sleeve portion over a predetermined angular range in a circumferential direction of the sleeve portion; and a torsion spring having one end portion fixed to the vane rotor and another end portion bent in a radially outward direction of the torsion spring and fixedly engaged with the cutout portion, wherein the cutout portion comprises one side wall surface, another side wall surface opposed to the one side wall surface in a substantially parallel relation thereto, and an end wall surface with which the another end portion of the torsion spring is engaged, the cutout portion being formed such that a first straight line extending through the end wall surface toward an inner peripheral side of the sleeve portion is located closer to the central axis of the sleeve portion than a second straight line extending through the another side wall surface toward the inner peripheral side of the sleeve portion, wherein the cutout portion comprises a stop to restrict displacement of the another end portion of the torsion spring in an axial direction of the torsion spring, wherein the cutout portion has a first circumferential width on the side of the axial end of the sleeve portion and a second circumferential width on a side of an opposite axial end of the sleeve portion which is larger than the first circumferential width, the stop extending by a difference between the first circumferential width and the second circumferential width.

2. The valve timing control apparatus as claimed in claim 1, wherein the first straight line substantially passes through the central axis of the sleeve portion.

3. The valve timing control apparatus as claimed in claim 1, wherein the stop is disposed between the one side wall surface and the end wall surface to form a step therebetween.

4. The valve timing control apparatus as claimed in claim 1, wherein the torsion spring is a coiled wire spring formed of a piece of wire having a generally rectangular shape in cross-section.

5. The valve timing control apparatus as claimed in claim 4, wherein the torsion spring has coils which are substantially contacted with each other.

6. The valve timing control apparatus as claimed in claim 5, wherein the piece of wire having the generally rectangular shape in cross-section has long opposite sides in a radial direction of the coiled wire spring.

7. The valve timing control apparatus as claimed in claim 1, wherein the one end portion of the torsion spring is bent in a radially inward direction of the torsion spring, and is fixedly engaged with a first engaging portion formed in an axial end surface of the rotor body.

8. The valve timing control apparatus as claimed in claim 7, wherein the one end portion of the torsion spring is prevented from falling off from the first engaging portion by a head of a cam bolt that serves to fix the vane rotor to a camshaft.

9. The valve timing control apparatus as claimed in claim 8, wherein the rotor body comprises a cylindrical bolt seat portion on which the head of the cam bolt is seated, and a spring seat portion formed on an outer peripheral side of the bolt seat portion, the spring seat portion being in the form of an annular groove on which a part of the torsion spring on a side of the one end portion is seated.

10. The valve timing control apparatus as claimed in claim 9, wherein the bolt seat portion has a chamfered portion at an outer peripheral edge of an end thereof, the chamfered portion having a conical shape or an arcuate vertical cross-section.

11. The valve timing control apparatus as claimed in claim 1, further comprising:

a rear plate fixed to the housing body on an opposite side of the front plate, the rear plate being formed with a pin engaging hole;

a pin accommodating hole extending through one of the plurality of vanes in an axial direction of the vane rotor;

a generally cylindrical lock pin slidably disposed in the pin accommodating hole, the lock pin being engageable in the pin engaging hole of the rear plate to restrict rotational movement of the vane rotor relative to the housing body; and a biasing member disposed between the lock pin and the front plate, the biasing member serving to bias the lock pin toward a side of the rear plate.

12. The valve timing control apparatus as claimed in claim 11, wherein the rotor body comprises a spring seat portion formed on an axial end of the rotor body, the spring seat portion serving as a seat on which the torsion spring is seated, and wherein the one of the plurality of vanes is formed with a communication groove serving to establish fluid communication between the pin accommodating hole and the spring seat portion.

13. The valve timing control apparatus as claimed in claim 12, wherein the communication groove is formed in an end surface, which faces to the front plate, of the one of the plurality of vanes.

14. The valve timing control apparatus as claimed in claim 12, wherein the communication groove is formed as a through hole formed in the one of the plurality of vanes.

15. The valve timing control apparatus as claimed in claim 12, wherein a corner portion between the another side wall surface and an inner peripheral surface of the sleeve portion is formed at an obtuse angle.

16. The valve timing control apparatus as claimed in claim 15, wherein the communication groove is formed in vicinity of the corner portion between the another side wall surface and the inner peripheral surface of the sleeve portion.

17. A valve timing control apparatus for an internal combustion engine, comprising:

a generally cylindrical drive rotation member rotatable by a rotational force that is transmitted from a crankshaft of the engine to the drive rotation member, the drive rotation member being opened to at least one axial end thereof, the drive rotation member defining a plurality of hydraulic chambers on an inner peripheral side thereof;

a vane rotor fixed to a camshaft, the vane rotor dividing the plurality of hydraulic chambers into a phase-advance hydraulic chambers and phase-retard hydraulic chambers, the vane rotor being rotatable relative to the drive rotation member toward a phase-advance side by supplying hydraulic pressure to the phase-advance hydraulic chambers and discharging hydraulic pressure from the phase-retard hydraulic chambers, the vane rotor being rotatable relative to the drive rotation member toward a phase-retard side by supplying hydraulic pressure to the phase-retard hydraulic chambers and discharging hydraulic pressure from the phase-advance hydraulic chambers;

a front plate fixed to an axial end of the drive rotation member, the front plate comprising a cylindrical sleeve portion that projects from a central portion of the front plate, and a cutout portion formed on a side of an axial end of the sleeve portion, the cutout portion extending through a circumferential wall of the sleeve portion in parallel to a radial direction of the sleeve portion over a predetermined angular range in a circumferential direction of the sleeve portion; and a torsion spring having one end portion fixed to the vane rotor and another end portion bent in a radially outward direction of the torsion spring and fixedly engaged with the cutout portion, wherein the cutout portion comprises one wall surface with which the another end portion of the torsion spring is engaged, and another wall surface opposed to the one wall surface, the another wall surface making an obtuse angle relative to a tangent to an inner peripheral surface of the sleeve portion, wherein the cutout portion comprises a stop to restrict displacement of the another end portion of the torsion spring in an axial direction of the torsion spring, wherein the cutout portion has a first circumferential width on the side of the axial end of the sleeve portion and a second circumferential width on a side of an opposite axial end of the sleeve portion which is larger than the first circumferential width, the stop extending by a difference between the first circumferential width and the second circumferential width.

18. A valve timing control apparatus for an internal combustion engine, comprising:

a generally cylindrical drive rotation member rotatable by a rotational force that is transmitted from a crankshaft of the engine to the drive rotation member, the drive rotation member being opened to at least one axial end thereof, the drive rotation member defining a plurality of hydraulic chambers on an inner peripheral side thereof;

a vane rotor fixed to a camshaft, the vane rotor dividing the plurality of hydraulic chambers into a phase-advance hydraulic chambers and a phase-retard hydraulic chambers, the vane rotor being rotatable relative to the drive rotation member toward a phase-advance side by supplying hydraulic pressure to the phase-advance hydraulic chambers and discharging hydraulic pressure from the phase-retard hydraulic chambers, the vane rotor being rotatable relative to the drive rotation member toward a phase-retard side by supplying hydraulic pressure to the phase-retard hydraulic chambers and discharging hydraulic pressure from the phase-advance hydraulic chambers;

a front plate fixed to an axial end of the drive rotation member, the front plate comprising a cylindrical sleeve portion that projects from a central portion of the front plate, and a cutout portion formed on a side of an axial end of the sleeve portion, the cutout portion extending through a circumferential wall of the sleeve portion in parallel to a radial direction of the sleeve portion over a predetermined angular range in a circumferential direction of the sleeve portion; and a torsion spring having one end portion fixed to the vane rotor and another end portion bent in a radially outward direction of the torsion spring and fixedly engaged with the cutout portion, wherein the cutout portion comprises one wall surface with which the another end portion of the torsion spring is engaged, and another wall surface opposed to the one wall surface, the cutout portion being formed in such a position that the one wall surface is located closer to a straight line extending across the central axis of the sleeve portion than the another wall surface, by cutting the circumferential wall of the sleeve portion along the radial direction of the sleeve portion by a punch having a predetermined width, wherein the cutout portion comprises a stop to restrict displacement of the another end portion of the torsion spring in an axial direction of the torsion spring, wherein the cutout portion has a first circumferential width on the side of the axial end of the sleeve portion and a second circumferential width on a side of an opposite axial end of the sleeve portion which is larger than the first circumferential width, the stop extending by a difference between the first circumferential width and the second circumferential width.

* * * * *